US007095969B2

(12) United States Patent
Imura

(10) Patent No.: US 7,095,969 B2
(45) Date of Patent: Aug. 22, 2006

(54) DEVELOPING DEVICE

(75) Inventor: Tomoyuki Imura, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 76 days.

(21) Appl. No.: 11/022,843

(22) Filed: Dec. 28, 2004

(65) Prior Publication Data

US 2006/0078342 A1 Apr. 13, 2006

(30) Foreign Application Priority Data

Oct. 12, 2004 (JP) ..... 2004-297154

(51) Int. Cl.
*G03G 15/06* (2006.01)

(52) U.S. Cl. ..... 399/55; 399/44; 399/285

(58) Field of Classification Search ..... 399/44, 399/97, 53, 55, 279, 281, 282, 283, 284, 399/285

See application file for complete search history.

(56) References Cited

U.S. PATENT DOCUMENTS 5,826,146 A * 10/1998 Maruta et al. ..... 399/235
5,970,280 A * 10/1999 Suzuki et al. ..... 399/55
6,223,004 B1 * 4/2001 Kodama ..... 399/44

FOREIGN PATENT DOCUMENTS

| | | |
|---|---|---|
| JP | 63-155065 | 6/1988 |
| JP | 05-011583 | 1/1993 |
| JP | 10-031358 | 2/1998 |
| JP | 10-133474 | 5/1998 |
| JP | 11-272069 | 10/1999 |

* cited by examiner

*Primary Examiner*—Hoang Ngo
(74) *Attorney, Agent, or Firm*—Morrison & Foerster LLP

(57) ABSTRACT

A developing device has a voltage application member which is in contact via a toner layer with a developing roller that rotates while holding the toner layer on its outer peripheral surface. A voltage that the voltage application member applies to the toner layer is switched between AC voltage and DC voltage based on humidity or drive cumulated time of the developing device.

16 Claims, 3 Drawing Sheets

DEVELOPING DEVICE

RELATED APPLICATION

This application is based on Japanese Patent Application No. 2004-297154, the content of which is incorporated herein by reference.

BACKGROUND OF THE INVENTION

The present invention relates to a developing device to be used for electrophotographic image formation apparatuses such as printers and copiers.

In electrophotographic image formation apparatuses such as printers and copiers, there has conventionally been used a developing device which develops with toner an electrostatic latent image formed on a surface of a photoconductor to visualize the image. This developing device generally has a developing roller or developing sleeve which rotates while holding charged toner on the outer peripheral surface in a thin layer state, so that toner is fed onto the photoconductor from the developing roller or the like.

Meanwhile, as printers have been wide-spreading in offices rapidly in recent years, users have been becoming increasingly more conscious of image quality and cost. One of image noise is 'fogging' which occurs due to deposition of the toner at portions other than the electrostatic latent image on the photoconductor. This occurs more often due to a deterioration of toner charge amount resulting from a deterioration of the toner within the developing device during endurance time. The deterioration of toner charge amount due to endurance causes not only image deteriorations but also increases in toner consumption, which substantially causes larger burdens of cost on users.

For electric charging of the toner in the developing device, there is a method that a blade-like member is brought into press contact against the developing roller and then the toner held on the developing roller in a thin layer state is electrically charged with a DC voltage applied thereto by the blade-like member. However, a nip width formed between the blade-like member and the developing roller, if small, would make it hard to impart a sufficient charge amount to deteriorated toner. Thus, for obtainment of larger nip width between the blade-like member and the developing roller, there have been proposed methods for bringing a flexible film-like member into contact with the developing roller in Japanese Patent Laid-Open Publications No. S63-155065, H05-11583, H05-224517, H09-90744, H10-31358, H10-133474, and H11-272069.

In the case where the nip width is broadened by using a film-like member and a DC voltage is applied to the toner layer via the film-like member, although even toner in a low-chargeability state can be charged up to a proper charge amount (e.g., −15 to −40 μc/g) so that occurrence of fogging can be reduced, yet toner in a good chargeability conversely would be overcharged (e.g., −40 μc/g or more). Overcharged toner, which is strongly restrained onto the developing roller by coulomb force, might become less likely to separate from the developing roller, adversely affecting the developability.

As a countermeasure for such overcharging, it is conceivable to lower the level of the DC voltage. However, such a countermeasure would lead to a weakening of the electric field for restraining the toner onto the developing roller, there would arise another issue that toner would stick to the film-like member.

SUMMARY OF THE INVENTION

Accordingly, an object of the present invention is to provide a developing device in which a proper charge amount is imparted to toner, whichever low or good in chargeability, so that the adverse effect to the developability and the toner sticking onto the voltage application member can be prevented and moreover the occurrence of the fogging can be reduced.

In order to achieve the above object, according to the present invention, there is provided a developing device comprising a voltage application member which is in contact via a toner layer with a developing roller that rotates while holding the toner layer on its outer peripheral surface, wherein a voltage that the voltage application member applies to the toner layer is switched between AC voltage and DC voltage based on a condition for toner chargeability.

It is noted here that the term "AC voltage" refers to an oscillatory voltage in which DC and AC components are superimposed on each other.

With the developing device of this constitution, when the toner chargeability is good, toner can be given a proper charge amount with application of an AC voltage that is low in effective value, by which the toner is prevented from being overcharged and therefore any adverse effects on the development can be avoided. Also, the toner is oscillated by the AC electric field, by which toner sticking onto the voltage application member can be prevented. On the other hand, when the toner chargeability is low, the toner can be given a proper charge amount with application of a DC voltage, by which charging deficiencies of toner can be improved and occurrence of the fogging can be reduced.

In the developing device of the present invention, the condition for toner chargeability may include drive cumulated time of the developing device. In this case, when the drive cumulated time of the developing device has exceeded a specified time, the voltage may be switched from AC voltage to DC voltage.

Also in the developing device of the invention, the condition for toner chargeability may include humidity. In this case, when the humidity has exceeded a specified value, the voltage may be switched from AC voltage to DC voltage. On the other hand, when the humidity has fallen below a specified value, the voltage may be switched from DC voltage to AC voltage.

In a first aspect of the present invention, there is provided an image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

an environmental condition sensor for detecting an environmental condition within the image formation apparatus; and a control unit for performing control of switching between the AC voltage and the DC voltage based on an output from the environmental condition sensor.

In the image formation apparatus of the first aspect of the invention, the environmental condition sensor may be either a humidity sensor or a temperature sensor.

Also in the image formation apparatus of the first aspect of the invention, the environmental condition sensor may include a humidity sensor and a temperature sensor, and the control unit may perform switching control between the AC voltage and the DC voltage based on an absolute humidity determined from respective outputs of the humidity sensor and the temperature sensor.

Also in the image formation apparatus of the first aspect of the invention, the control unit may switch the voltage applied to the voltage application member from AC voltage to DC voltage when the humidity has exceeded a specified value, and may switch the voltage applied to the voltage application member from DC voltage to AC voltage when the humidity is not higher than the specified value.

Further, in the image formation apparatus of the first aspect of the invention, the switching between AC voltage and DC voltage may be prohibited during an image-forming operation for one sheet or image-forming operations for a plurality of sheets of one job.

In a second aspect of the invention, there is provided an image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

a counter for cumulatively totalizing drive time of the developing device; and a control unit for performing control of switching between the AC voltage and the DC voltage based on an output from the counter.

In the image formation apparatus of the second aspect of the invention, the control unit may switch the voltage applied to the voltage application member from AC voltage to DC voltage when a count value of the counter has exceeded a specified value.

In a third aspect of the invention, there is provided an image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

a humidity sensor for detecting a humidity within the image formation apparatus;

a counter for cumulatively totalizing drive time of the developing device; and a control unit for performing control of switching between the AC voltage and the DC voltage based on respective outputs from the humidity sensor and the counter.

As described above, according to the developing device and the image formation apparatus of the present invention, a proper charge amount can be imparted to toner, whichever the toner is in a low or good state of chargeability. Thus, the adverse effect on the developability as well as the toner sticking onto the voltage application member can be prevented while the occurrence of fogging can be reduced.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
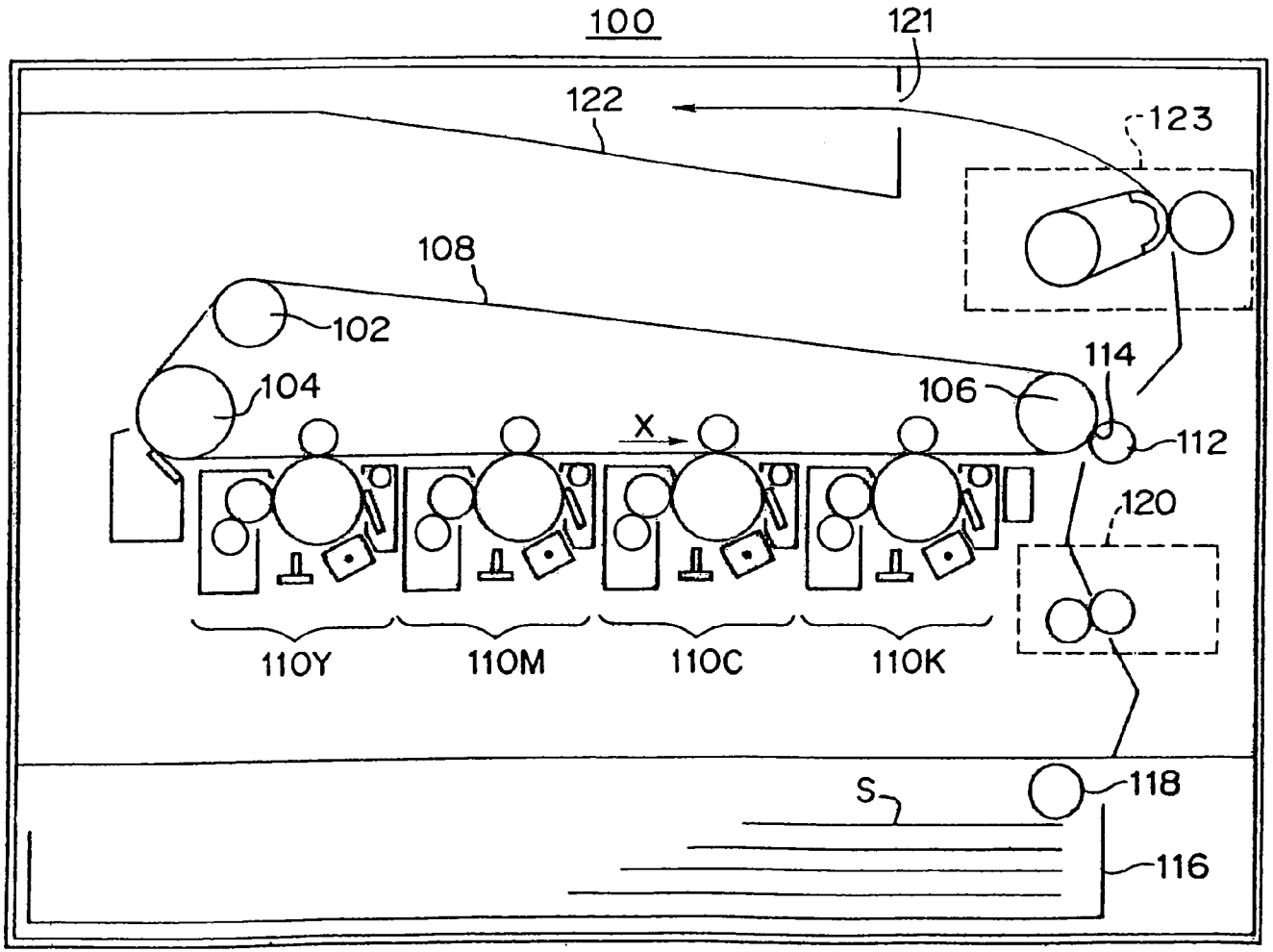
FIG. 1 is a schematic structural view of an image formation apparatus.

FIG. 1 is a schematic view of an image formation apparatus 100 using a developing device which is an embodiment of the invention. The image formation apparatus 100 has an intermediate transfer belt 108 which is supported by three rollers 102, 104, 106 and driven into rotation in a direction of arrow X.

Under the intermediate transfer belt 108 are arrayed image making units 110Y, 110M, 110C, 110K corresponding to color toners of yellow (Y), magenta (M), cyan (C), black (K), respectively. These image making units 110Y, 110M, 110C, 110K allow a four-color toner image to be formed by superimposition on the intermediate transfer belt 108.

A transfer roller 112 is placed, in contact, at a portion of the intermediate transfer belt 108 at which it is supported by the roller 106. A transfer area 114 is provided between this transfer roller 112 and the intermediate transfer belt 108.

A sheet feed cassette 116 for accommodating sheets S is placed at a lower portion of the image formation apparatus 100. The sheets S loaded and accommodated in the sheet feed cassette 116 is to be fed out one by one by a sheet feed roller 118.

A sheet S fed out from the sheet feed cassette 116 is conveyed generally vertically by a sheet conveyance unit 120 or the like. During the conveyance process, the toner image is transferred onto the sheet S from the intermediate transfer belt 108 while the sheet S is passing through the transfer area 114, subsequently the sheet S with the toner image carried thereon has the toner image fixed while passing through a fixing unit 123, and then the sheet S with the toner image fixed thereto is discharged to a sheet discharge tray 122 provided at an upper portion of the image formation apparatus 100 via a sheet discharge port 121.

Figure 2:
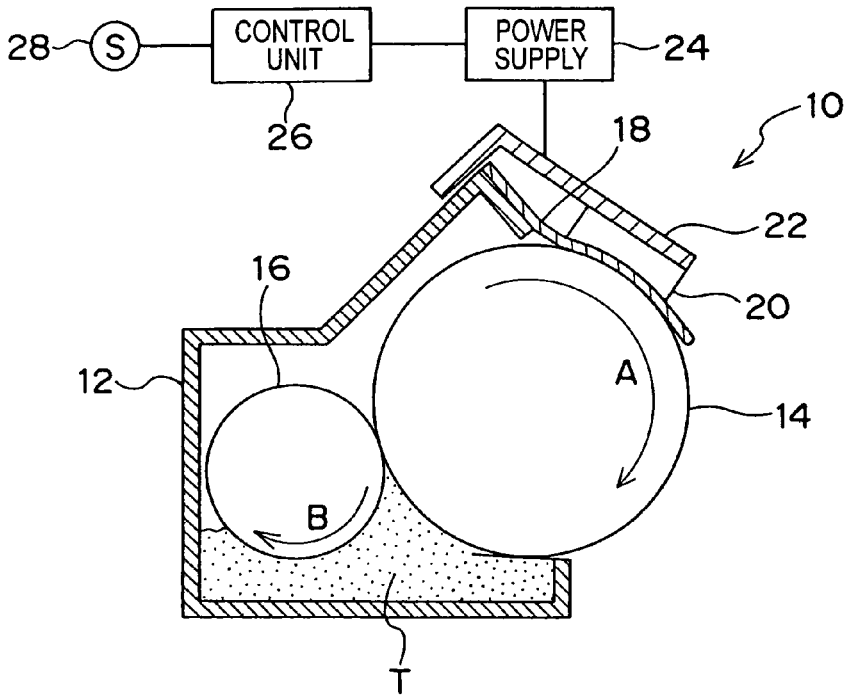
FIG. 2 is a schematic structural view of a developing device.

FIG. 2 is a schematic structural view of a developing device 10 provided in each of the image making units 110Y, 110M, 110C, 110K. The developing device 10 includes a casing 12 formed of a housing body in which toner T is housed. An opening extending along the longitudinal direction (depth-wise direction of FIG. 2) is formed in the casing 12, and a developing roller 14 is provided at the opening so as to be drivable into rotation along a direction of arrow A. In the developing device 10, the developing roller 14 is placed in opposition and proximity to an unshown photoconductor.

In the casing 12, a feed roller 16 is disposed in contact with the developing roller 14. As the feed roller 16 is driven into rotation along a direction of arrow B, the toner T is fed to the developing roller 14 so that a thin toner layer is formed on the outer peripheral surface of the developing roller 14.

On top of the casing 12 is fixed a voltage application member 18 formed of, for example, an electrically semiconductive flexible resin film. The voltage application member 18 is pressed against the developing roller 14 by a backup member 20 which is attached to an electrode 22 and formed of, for example, an electrically conductive sponge. As a result, the voltage application member 18 is in contact with the developing roller 14 over a specified angle range via the toner layer held on the outer peripheral surface.

A power supply 24 is electrically connected the electrode 22. To the voltage application member 18, a voltage is to be applied via the backup member 20 from the electrode 22 by the power supply 24. The power supply 24 is enabled to apply a DC voltage or an AC voltage (an oscillatory voltage in which DC and AC components are superimposed on each other; also applicable hereinafter) to the electrode 22.

A control unit 26 is electrically connected to the power supply 24. The power supply 24 switches the voltage to be applied to the electrode 22 between DC voltage and AC voltage according to a signal derived from the control unit 26.

The control unit 26 includes a counter for counting drive cumulated time of the developing device 10, and outputs a voltage switching signal to the power supply 24 based on a humidity in the image formation apparatus 100 outputted from a humidity sensor (environmental condition sensor) 28 as well as the drive cumulated time of the developing device 10. In addition, image-formation cumulated sheet count of the image formation apparatus 100 may substitute for the drive cumulated time of the developing device 10.

Next, operations of the developing device 10 having the above constitution are described.

In the developing device 10, as the developing roller 14 is driven into rotation along the direction of arrow A, the feed roller 16 is rotationally driven along the direction of arrow B. The toner T housed in the casing 12 is fed to the developing roller 14 by the rotating feed roller 16, by which a thin toner layer is formed on the outer peripheral surface of the developing roller 14.

The toner layer on the outer peripheral surface of the developing roller 14 is moved to a contact area with the voltage application member 18 as the developing roller 14 rotates. During the passage through this contact area, the toner is electrically charged by the voltage application member 18 to which a voltage is applied, where the voltage to be applied to the voltage application member 18 is controlled as follows.

For instance, in a normal condition in which the humidity is not higher than a specified value, or in an initial or midway stage in which the drive cumulated time of the developing device 10 is less than a specified time, since the toner chargeability is still good, the control unit 26 makes an AC voltage applied from the power supply 24 to the voltage application member 18. The AC voltage in this case is, for example, a rectangular-wave oscillatory voltage that oscillates between 0 V and −200 V at a frequency of 2 kHz.

Since such an AC voltage has a small effective value that contributes to toner charging, the toner is given a desired charge amount (e.g., −25 to −35 μc/g) without being overcharged. As a result, the adverse effect on the developability that toner overcharging may make it harder to achieve the development can be avoided. Also, since the toner is oscillated by an action of the AC electric field formed between the voltage application member 18 and the developing roller 14 by the application of the AC voltage, toner sticking onto the voltage application member 18 can be prevented.

Meanwhile, for instance, in a high-humidity environmental condition in which the humidity has exceeded a specified value or in a late stage in which the drive cumulated time of the developing device 10 has exceeded a specified time, since the toner chargeability has deteriorated, the control unit 26, in this case, makes a DC voltage of, for example, −200 V applied from the power supply 24 to the voltage application member 18. As a result, the toner can be given a desired charge amount, so that occurrence of the fogging due to toner charging failures can be reduced.

As described above, according to the developing device 10 of this embodiment, a desired charge amount can be imparted to toner, whichever the toner is in a low or good state of chargeability. Thus, the adverse effect on the developability as well as the toner sticking onto the voltage application member 18 can be prevented while the occurrence of fogging can be reduced.

The toner layer that has passed through the contact area with the voltage application member 18 is moved to an opposing area opposite to the photoconductor as the developing roller 14 rotates. At this location, the toner layer is offered for the development of an electrostatic latent image formed on the photoconductor surface, by which a toner image is formed.

In addition, when the humidity has lowered to or under a specified value so that a high-humidity environment has changed over to a normal state, the control unit 26 switches the voltage, which is to be applied from the power supply 24 to the voltage application member 18, from a DC voltage to an AC voltage, converse to the above-described case, unless the drive cumulated time of the developing device 10 is in a late stage.

Also, the switching between AC voltage and DC voltage as described above is prohibited during the image forming operation for one sheet or the image forming operations for a plurality of sheets of one job. This is purposed to avoid any changes in development conditions during a sequence of image forming operation.

The switching between AC voltage and DC voltage is performed based on humidity and the drive cumulated time of the developing device 10 in this embodiment. However, the switching may also be done based on development conditions (e.g., developing bias) or latent image conditions (e.g., printed area rate) or the like.

Further, in this embodiment, the switching control between AC voltage and DC voltage is performed based on relative humidity or drive cumulated time. However, since an image formation apparatus is generally equipped with a temperature sensor (environmental condition sensor) for detecting environmental temperature, it is also possible that the switching control may be done based on environmental temperature or based on absolute humidity, which is determined from relative humidity and environmental temperature.

Next, an experiment which was performed to verify the working effects of the developing device 10 of this embodiment is described.

In this experiment, a low-resistivity film having a volume resistivity of $10^3$ to $10^8$ Ω·cm with a uniform thickness within a range of several tens to several hundreds of μm was used as the voltage application member 18. The voltage to be applied to the voltage application member 18 was assumed as either one of a DC voltage or an AC voltage in a Comparative Example, while the voltage was switched between AC voltage and DC voltage according to a humidity state and an endurance state as shown in the following Table 1 in a Working Example of the developing device 10. Referring to Table 1, numerical values of −100, −200 and −300 show DC voltages in volts (V), $V_{pp}$100 shows an AC voltage that oscillates between peak voltages of 0 V and −100 V at a frequency of 2 kHz, $V_{pp}$150 shows an AC voltage that oscillates between peak voltages of 0 V and −150 V at a frequency of 2 kHz, $V_{pp}$200 shows an AC voltage that oscillates between peak voltages of 0 V and −200 V at a frequency of 2 kHz.

TABLE 1

| | Initial | Midway | Late |
|---|---|---|---|
| High humidity | −100 | −200 | −300 |
| Normal | $V_{pp}$100 | $V_{pp}$200 | −200 |
| Low humidity | $V_{pp}$100 | $V_{pp}$150 | $V_{pp}$200 |

Figure 3:
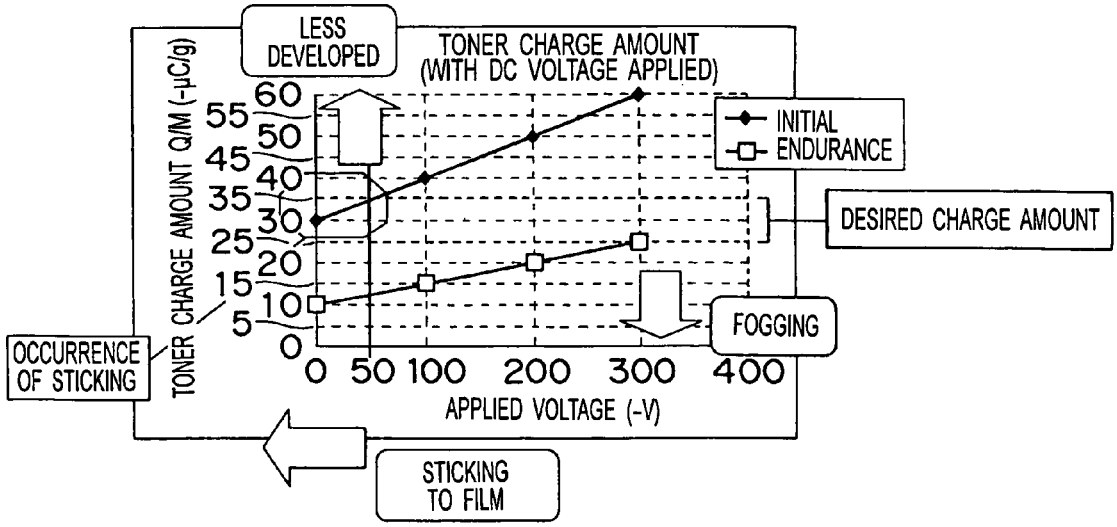
FIG. 3 is a graph showing variations in toner charge amount with DC voltage used as the charging voltage.

First, results of checking variations in toner charge amount in an initial state and after endurance with DC voltages applied as the charging voltage in the Comparative Example are shown in the graph of FIG. 3. In the initial state in which the toner chargeability was good, although a desired charge amount (−25 to −35 uc/g) was able to be obtained within an applied voltage range of 0 to −50 V, the electric field for restraining the toner onto the developing roller became weaker because of a low level of the applied voltage so that toner sticking onto the voltage application member 18 occurred. Also, with the applied voltage increased over −50 V, the toner came to an overcharged state so that a detrimental effect toward deteriorated developability occurred. On the other hand, after the endurance in which toner chargeability had become lower due to deterioration, a desired charge amount was unable to be obtained with the applied voltage not more than −300 V so that a fogging occurred. In addition, increasing the applied voltage over −300V would make it more likely that leakage may occur between the voltage application member 18 and the developing roller 14, thus undesirable.

Figure 4:
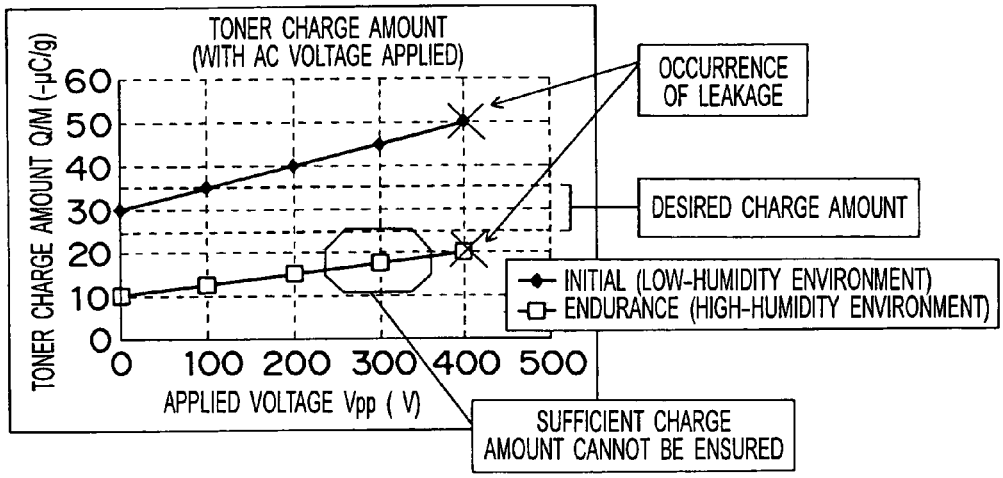
FIG. 4 is a graph showing variations in toner charge amount with AC voltage used as the charging voltage.

Subsequently, results of checking variations in toner charge amount in an initial state under a low-humidity environment in which toner chargeability was good and in a post-endurance state under a high-humidity environment in which toner chargeability had become lower, with AC voltage used as the charging voltage in the Comparative Example are shown in the graph of FIG. 4. In this graph, applied voltages $V_{pp}$ are similar to those described with reference to Table 1. The results shown by the graph of FIG. 4 are generally similar to those shown in FIG. 3. That is, although a desired charge amount was able to be obtained within an applied voltage range of 0 to 100 V, yet with $V_{pp}$ increased over 100 V, the toner came to an overcharged state so that a detrimental effect toward deteriorated developability occurred. In addition, since toner is oscillated by an oscillatory electric field in the case of AC voltage, toner sticking onto the voltage application member 18 did not occur. On the other hand, after the endurance in which toner chargeability had become lower due to deterioration, a desired charge amount was unable to be obtained with the applied voltage not more than −300 V so that a fogging occurred. After the endurance, on the other hand, a desired charge amount was unable to be obtained even with the applied voltage $V_{pp}$ increased, and a fogging occurred. In addition, with an applied voltage $V_{pp}$ of 400 V, leakage occurred between the voltage application member 18 and the developing roller 14.

Figure 5:
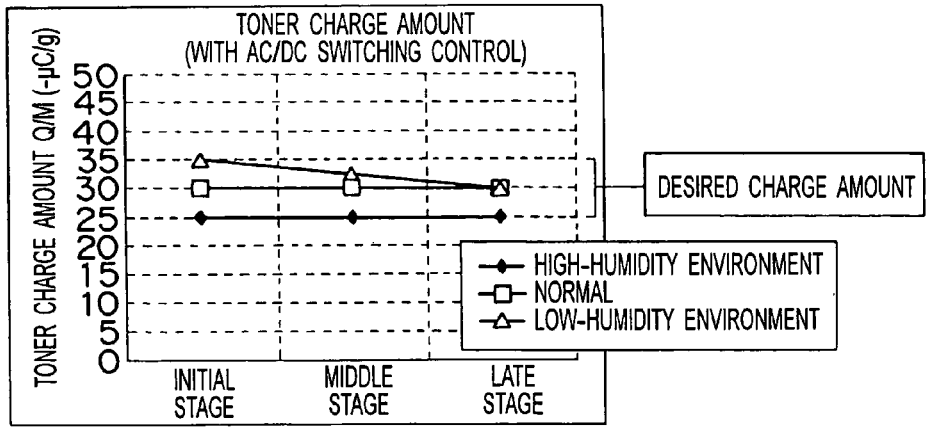
FIG. 5 is a graph showing variations in toner charge amount with switching control performed between AC voltage and DC voltage.

Finally, shown in a graph of FIG. 5 are results of checking variations in toner chargeability in a low-humidity environment and a normal state of good toner chargeability, and in a high-humidity environment of low toner chargeability, under switching control of the applied voltage performed between AC voltage and DC voltage as shown in Table 1 in the Working Example of the developing device 10. As apparent from this graph, a desired toner charge amount was able to be obtained over the initial, middle and late stages in the endurance life of the developing device 10. Thus, according to the developing device 10 of this embodiment, it was verified that a desired charge amount can be imparted to toner, whichever the toner is in a low or good state of chargeability so that the adverse effect on the developability as well as the toner sticking onto the voltage application member 18 can be prevented while the occurrence of fogging can be reduced.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device comprising a voltage application member which is in contact via a toner layer with a developing roller that rotates while holding the toner layer on its outer peripheral surface, wherein a voltage that the voltage application member applies to the toner layer is switched between AC voltage and DC voltage based on a condition for toner chargeability.

2. The developing device as claimed in claim 1, wherein the condition for toner chargeability includes drive cumulated time of the developing device.

3. The developing device as claimed in claim 2, wherein when the drive cumulated time of the developing device has exceeded a specified time, the voltage is switched from AC voltage to DC voltage.

4. The developing device as claimed in claim 1, wherein the condition for toner chargeability includes humidity.

5. The developing device as claimed in claim 4, wherein when the humidity has exceeded a specified value, the voltage is switched from AC voltage to DC voltage.

6. The developing device as claimed in claim 4, wherein the humidity has fallen below a specified value, the voltage is switched from DC voltage to AC voltage.

7. An image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

an environmental condition sensor for detecting an environmental condition within the image formation apparatus; and a control unit for performing control of switching between the AC voltage and the DC voltage based on an output from the environmental condition sensor.

8. The image formation apparatus as claimed in claim 7, wherein the environmental condition sensor is a humidity sensor.

9. The image formation apparatus as claimed in claim 7, wherein the environmental condition sensor is a temperature sensor.

10. The image formation apparatus as claimed in claim 7, wherein the environmental condition sensor includes a humidity sensor and a temperature sensor, and the control unit performs switching control between the AC voltage and the DC voltage based on an absolute humidity determined from respective outputs of the humidity sensor and the temperature sensor.

11. The image formation apparatus as claimed in claim 8, wherein the control unit switches the voltage applied to the voltage application member from AC voltage to DC voltage when the humidity has exceeded a specified value, and switches the voltage applied to the voltage application member from DC voltage to AC voltage when the humidity is not higher than the specified value.

12. The image formation apparatus as claimed in claim 7, wherein the switching between AC voltage and DC voltage is prohibited during an image-forming operation for one sheet.

13. The image formation apparatus as claimed in claim 7, wherein the switching between AC voltage and DC voltage is prohibited during image-forming operations for a plurality of sheets of one job.

14. An image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

a counter for cumulatively totalizing drive time of the developing device; and a control unit for performing control of switching between the AC voltage and the DC voltage based on an output from the counter.

15. The image formation apparatus as claimed in claim 14, wherein the control unit switches the voltage applied to the voltage application member from AC voltage to DC voltage when a count value of the counter has exceeded a specified value.

16. An image formation apparatus for forming an image by developing an electrostatic latent image formed on a photoconductor by using a developing device and moreover transferring a developed toner image onto a paper sheet, wherein the developing device comprises:

a developing roller which is placed in opposition to the photoconductor and which holds a toner layer on an outer peripheral surface thereof;

a voltage application member which is placed in contact with the developing roller and which electrically charges the toner layer held on the developing roller;

a power supply capable of applying an AC voltage or a DC voltage to the voltage application member;

a humidity sensor for detecting a humidity within the image formation apparatus;

a counter for cumulatively totalizing drive time of the developing device; and a control unit for performing control of switching between the AC voltage and the DC voltage based on respective outputs from the humidity sensor and the counter.

* * * * *